US005117743A

United States Patent [19]

Yuda

[11] Patent Number: 5,117,743

[45] Date of Patent: Jun. 2, 1992

[54] COMPACT FLUID OPERATED CYLINDER AND METHOD

[76] Inventor: Lawrence F. Yuda, P.O. Box 176, Westminster, S.C. 29693

[21] Appl. No.: 628,982

[22] Filed: Dec. 17, 1990

Related U.S. Application Data

[63] Continuation of Ser. No. 520,132, May 7, 1990, abandoned, which is a continuation of Ser. No. 227,235, Aug. 1, 1988, abandoned, which is a continuation-in-part of Ser. No. 25,596, Mar. 13, 1987, abandoned.

[51] Int. Cl.[5] ..... F01B 29/00; F16J 15/18

[52] U.S. Cl. ..... 92/128; 92/165 R; 92/171.1; 277/167.5

[58] Field of Search ..... 92/128, 169.1, 165 R, 92/171.1; 285/321, 918, 921; 277/167.5; 403/326

[56] References Cited

U.S. PATENT DOCUMENTS

| | | | |
|---|---|---|---|
| 2,453,391 | 11/1948 | Whittingham | 285/918 X |
| 3,101,984 | 8/1963 | Wieckmann | 285/918 X |
| 3,494,652 | 2/1970 | Langland | 92/128 X |
| 3,650,182 | 3/1972 | Phillips | 92/128 |
| 3,667,785 | 6/1972 | Kapeker | 285/321 X |
| 4,167,134 | 9/1979 | Yuda | 92/163 X |
| 4,242,947 | 1/1981 | Renner et al. | 92/137 X |
| 4,451,069 | 5/1984 | Melone | 285/921 X |
| 4,565,506 | 1/1986 | Williams | 92/128 X |
| 4,863,199 | 9/1989 | Hojo et al. | 285/321 X |
| 4,924,758 | 5/1990 | Yuda | 92/169.1 X |
| 4,978,147 | 12/1990 | Henderson, Jr. et al. | 285/321 X |

FOREIGN PATENT DOCUMENTS

| | | | |
|---|---|---|---|
| 543733 | 3/1942 | United Kingdom | 285/321 |

*Primary Examiner*—Edward K. Look
*Assistant Examiner*—John Ryznic
*Attorney, Agent, or Firm*—Bailey & Hardaway

[57] ABSTRACT

A fluid operated apparatus having a cylinder assembly, a piston and a rod is illustrated wherein cap members are provided with a first circumferential groove and a reduced end portion while a second circumferential groove is carried opposite the first circumferential groove within the cylinder assembly forming a seat for a deformable ring. A method of assembling the fluid operated apparatus contemplates inserting an end cap into the cylinder and then mounting a deformable ring in an adjacent groove in the cylinder and then forcing the cap out so that the ring passes over a reduced conical end portion of the cap and is positioned in the seat formed between the opposed grooves for deforming the ring.

5 Claims, 6 Drawing Sheets

COMPACT FLUID OPERATED CYLINDER AND METHOD

This application is a continuation of application Ser. No. 07/520,132 filed May 7, 1990, now abandoned which is a continuation of application Ser. No. 07/227,235; filed Aug. 1, 1988, now abandoned, which is a continuation-in-part of application Ser. No. 07/025,596, filed Mar. 13, 1987, now abandoned.

BACKGROUND OF THE INVENTION

This invention relates to compact cylinders which are useful for a variety of purposes but which may preferably be of the general type illustrated in U.S. Pat. No. 4,167,134. As is customary, the end caps of the cylinder of the patent are secured by a mechanical bond provided by a metallic ring carried within a groove in the cylinder wall and bearing against a surface of the end cap for retaining same within the cylinder walls. An O-ring constructed of deformable material is carried within a groove within the end cap and provides a fluid seal. Such cylinders are useful in connection with robotic grippers, for example, and U.S. Pat. Nos. 4,566,727 and 4,492,400 are exemplary of such constructions.

Since such end caps may often move to a limited extent axially as provided by the mechanical bond, the end cap may strike the mechanical bonding member resulting in noisy operation. Since more than one groove must be provided within the cylinder walls and end caps for accommodating the mechanical bonding member and the sealing member respectively, the grooves may not be carried opposite each other but rather must be longitudinally spaced so that a relative thickness in the area of the end caps is necessitated.

Accordingly, an important object of the present invention is the provision of a more compact cylinder wherein the end caps can be made thinner because of opposed grooves provided in the walls of the cylinder and end caps forming a seat for single deformable members which serves both to bond the end caps entirely within the cylinder walls as well as a sealing member therebetween.

Another important object of the invention is the provision of a deformable resilient bond between the end caps and the cylinder walls adjacent their ends so as to function as a sound reducing means since there is no mechanical bond as afforded by a metallic ring as would result in noisy operation but rather the resilient deformable member which serves as a sealing and a bonding member also serves to cushion sound as well as shock.

Still another important object of the invention is the provision of a tapered ramp formed by a substantially conical surface at the open end of each of the caps facilitating assembly by avoiding twisting of the O-ring together with a retaining ridge which extends inwardly short of a center line of the O-ring and beyond the initial groove surface of the cylinder to deform the ring in such a way as to provide even greater force requirements for dislodging the ring in an outward direction than forces required to dislodge the end caps of the other embodiments herein.

SUMMARY OF THE INVENTION

It has been found that a more compact cylinder or fluid operated apparatus may be provided by utilizing opposed grooves in the cylinder walls and in the end cap members to form seats for deformable rings which act as sealing members and afford a bond or a retaining member for positioning the end cap entirely within the respective ends of the cylinder walls on either side of the piston.

The method of assembling the apparatus contemplates first inserting or sliding an end cap into one end of the cylinder and mounting or installing an O-ring or other deformable resilient ring into an adjacent groove in the cylinder wall. The cap is then forced outwardly by action of the piston when a force is exerted against the rod to cause a reduced end of the cap to pass over the deformable ring so that the ring becomes seated between opposed grooves in the cap and in the cylinder wall respectively. An enlarged shoulder is carried by the cap member which prevents further outward movement of the end cap so that the end cap is retained and confined entirely within the cylinder walls and a seal is provided between the cap and the cylinder walls.

It has further been found that a ramp may be defined by a substantially conical surface extending from an outer end of the cap inwardly of the circumferential groove of the cylinder and tapering inwardly progressively enlarging a circumference of the end cap defined by the ramp terminating short of the center line of the deformable ring. Such a construction increases the force required for outer dislodging of the end cap and facilitates assembly since there is a reduced tendency for twisting of the O-ring as the ramp passes over the O-ring.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

A fluid operated apparatus having a cylinder assembly, a piston and a rod carried thereby is illustrated. Cap members located entirely within the cylinder are carried on each side of the piston having a first circumferential groove A, and a reduced end portion B extending from the groove to an outer end of the cap member. A second circumferential groove C is carried within the cylinder assembly adjacent each end thereof opposite the first circumferential groove. A deformable ring D is carried within a space defined between the first and second circumferential grooves in a compressed deformed state reduced end portion B also includes a ramp which, together with the first groove A, forms a beveled retaining ridge or edge having a flat apex which works to deform the deformable ring D. A beveled surface is also provided at an outer edge of the cap. Thus, a fluid seal is provided between a cylinder assembly and a cap member while the cap member is retained entirely within the cylinder.

The method of assembling such an apparatus contemplates inserting one of the end caps into the cylinder past one of the grooves in the cylinder assembly on one side of the piston. A deformable sealing ring is mounted in said one of said grooves, and the reduced end portion of the cap is forced past the sealing ring until the sealing ring seats in opposed annular grooves. The other of the end caps is inserted into the cylinder past the other of the grooves in the cylinder on the other side of the piston. A deformable sealing ring is mounted in the other of the grooves, and a reduced end portion of the cap is forced past the sealing ring until the sealing ring seats in opposed annular grooves.

Figure 1:
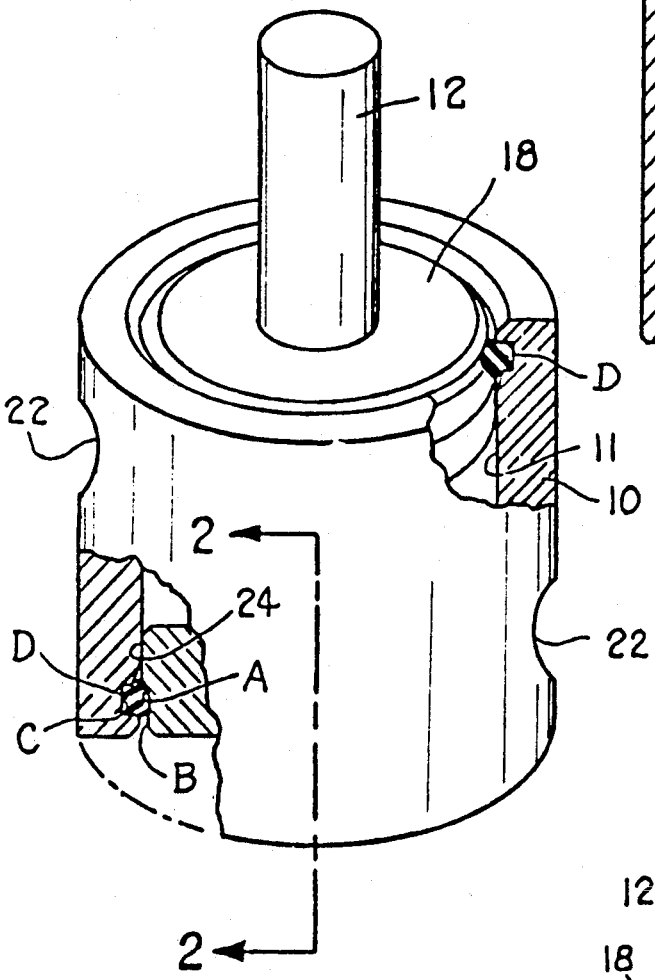
FIG. 1 is a perspective view illustrating a compact fluid operated apparatus with parts broken away for illustrating the structure for retaining the end caps while at the same time providing a seal in accordance with the invention.
Figure 2:
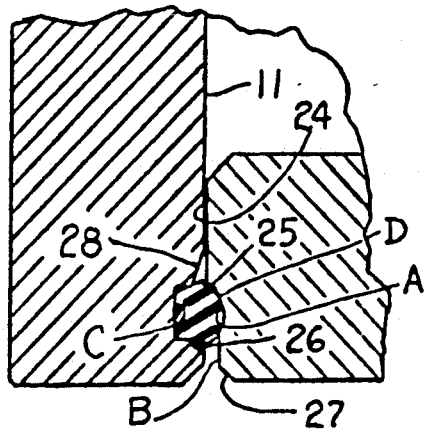
FIG. 2 is an enlarged transverse sectional elevation taken on the line 2—2 in FIG. 1.
Figure 3:
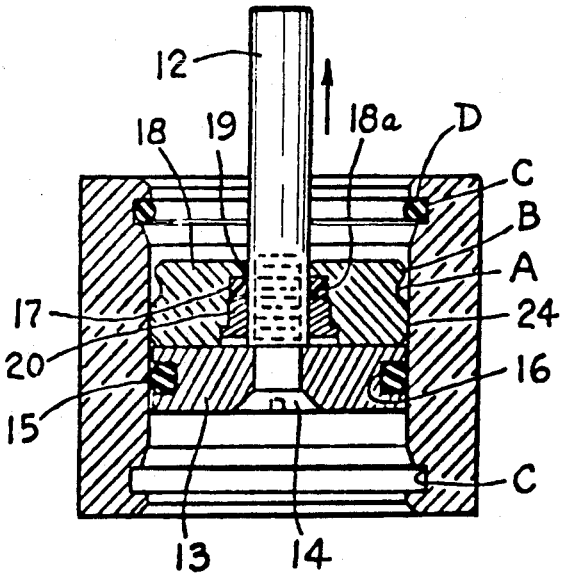
FIG. 3 is a sectional elevation at a reduced scale illustrating a first step in the installation of a resilient deformable ring to position one of the end caps in accordance with the method of the invention.
Figure 4:
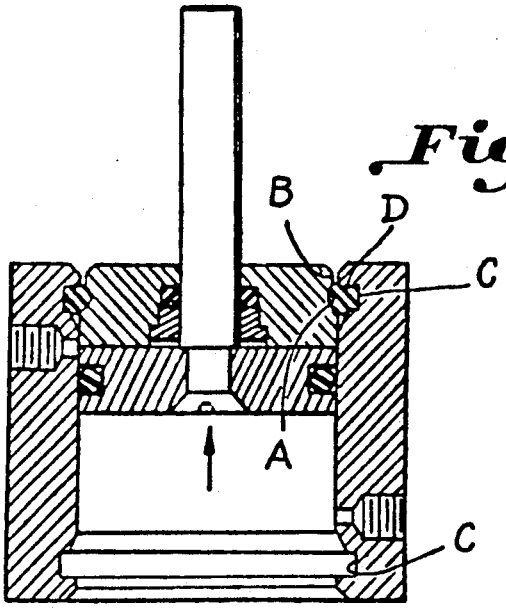
FIG. 4 is a sectional elevation illustrating a next step in the assembly of the apparatus wherein the end cap is forced by the cylinder over the deformable ring at a reduced end seating the deformable ring in the area between the opposed grooves which forms a seat for the ring.
Figure 5:
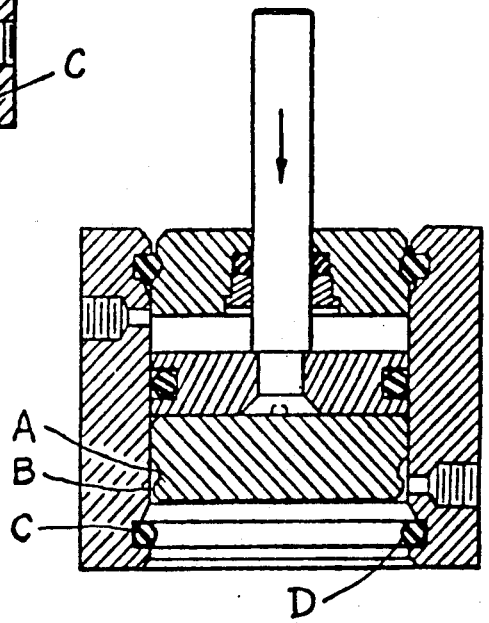
FIG. 5 is a sectional elevation similar to FIG. 2 wherein a second end cap has been inserted and a resilient deformable ring mounted in a groove adjacent the end of the cylinder walls.
Figure 6:
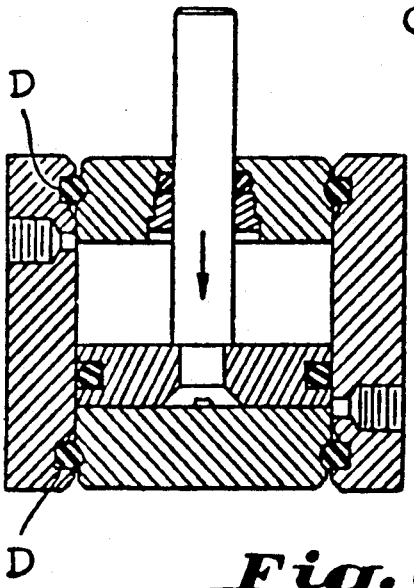
FIG. 6 is a sectional elevation similar to FIG. 4 showing the final step in forcing the other cap outwardly to seat the deformable ring.

Referring more particularly to FIG. 1, a fluid operated apparatus or air cylinder and the like is illustrated as having a cylinder assembly 10 provided with inner walls 11. A piston rod 12 is connected to a piston 13, FIGS. 3-6. The rod 12 is connected to the piston as by a threaded bolt 14 which is threadably received within the piston rod. A sealing member is provided in the form of an O-ring 15 carried within a groove 16 in the piston. Sealing means are provided by an O-ring 17 carried within a groove 18*a* within a cap 18 which provides an opening 19 for slideably receiving the rod 12. A retaining member 20 is provided for seating the O-ring.

It will be observed that fluid ports 22 are provided adjacent each end of the cylinder 10. The cap members are each provided with an annular groove A which joins a reduced end portion B. Thus, an enlarged shoulder 24 is formed on the inner end of the respective end caps. An annular groove C is provided in the respective ends of the cylinder walls 11 for accommodating a resilient deformable member such as the O-ring D which may be constructed as of the usual rubbery material. The opposed retaining edges of the respective grooves illustrated at 25 and 26 are beveled, and a bevel 27 is provided at an outer edge of the cap.

Figure 7:
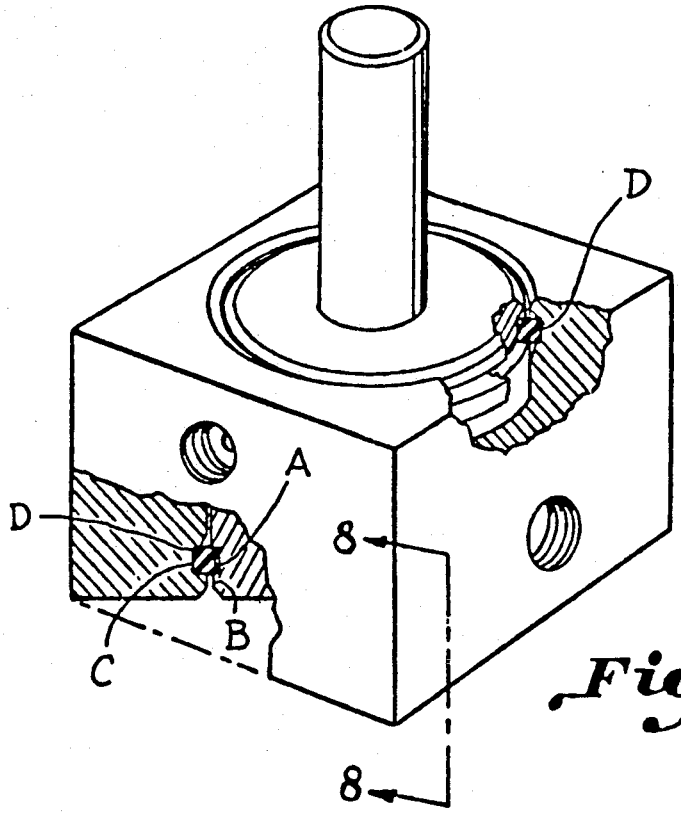
FIG. 7 is a perspective view illustrating a modified form of the invention wherein the cylinder housing is square and the deformable ring of a rectangular or square configuration having flats.
Figure 8:
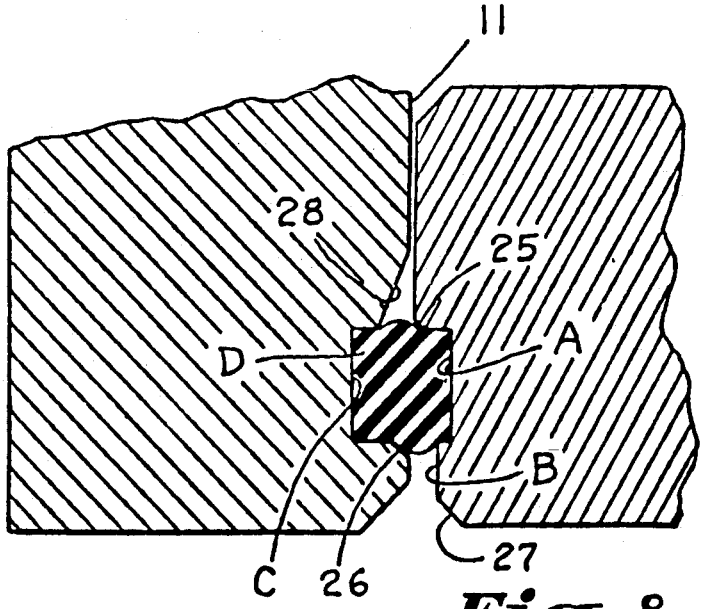
FIG. 8 is an enlarged sectional elevation taken on the line 8—8 in FIG. 7 illustrating the deformable ring and associated groove and cap constructions.
Figure 9:
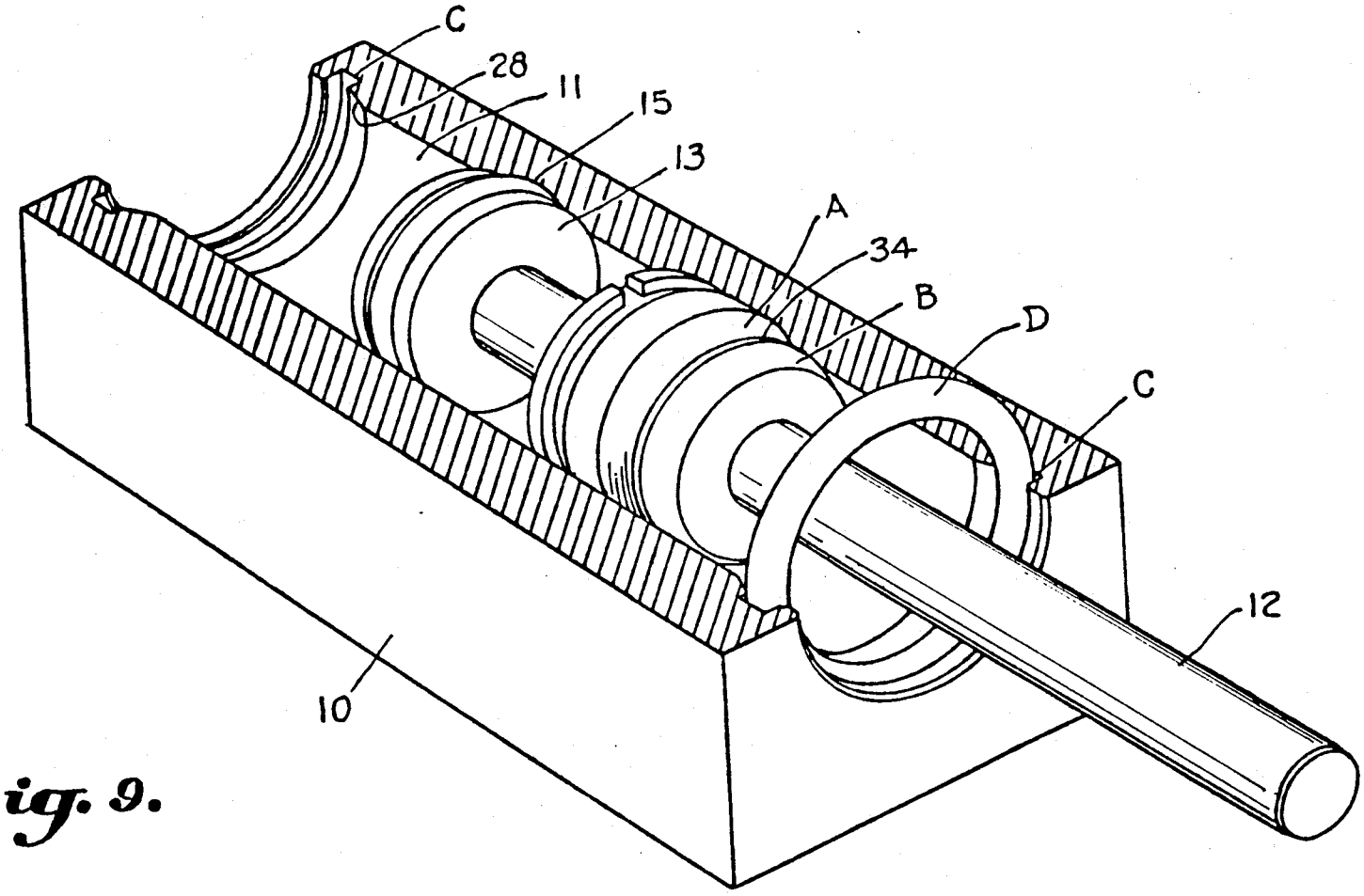
FIG. 9 is a perspective view illustrating a first step in the assembly of the cylinder and piston wherein the piston and piston rod are inserted in the cylinder and O-ring positioned within a groove within the cylinder.
Figure 11:
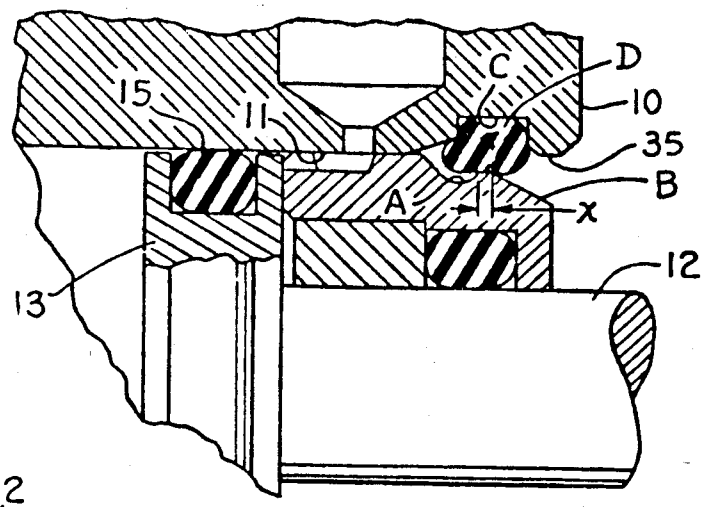
FIG. 11 is a transverse sectional elevation further illustrating the assembly of the apparatus wherein the end cap is passing beneath the O-ring preparatory to seating the O-ring in the groove of the end cap.
Figure 10:
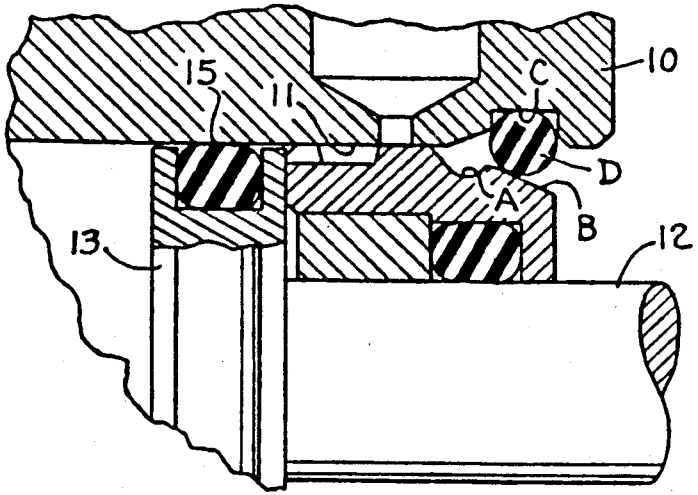
FIG. 10 is a transverse sectional elevation illustrating a second step in the assembly operation wherein the end cap is moved outwardly with the ramp passing through the O-ring.

FIGS. 7 and 8 illustrate a modified form of the invention wherein a square cylinder is utilized and a square deformable ring D is illustrated. FIG. 8 shows a deformation of the ring against a force tending to dislodge the end cap outwardly. As in the first embodiment a tapering surface 28 is provided to facilitate positioning of the deformable ring D with the groove C. A beveled edge is illustrated at 27 at an outer edge of the cap while opposed bevels 25 and 26 are carried at opposite edges of the grooves A and C respectively.

The fluid operated apparatus of FIGS. 9-13 is illustrated as having a cylinder assembly, a piston and a rod carried thereby. Cap members are carried entirely within said cylinder assembly on at least one side of said piston having a first circumferential groove A therein. A reduced end portion B extends from the groove A to an outer end of the cap member. A second circumferential groove C is carried within the cylinder assembly adjacent an end thereof opposite the first circumferential groove of the cap member. A deformable ring D is carried within a space defined between the first and second circumferential grooves in a compressed deformed state for positioning said cap member within said cylinder assembly and providing a fluid seal between the cylinder assembly and the cap member. The reduced end portion B includes a ramp defined by a substantially conical surface extending from an outer end of the end cap inwardly of the second circumferential groove and tapering inwardly progressively enlarging a circumference of the end cap defined by the ramp terminating short of a center line of the deformable ring. Thus, a compact cap member and a correspondingly compact apparatus is provided as the single deformable ring serves both to position the end cap and to provide a fluid seal.

The ramp extends continuously expanding at an angle on the order of about 20 degrees. The ramp and the first groove C form a retaining ridge having a flat apex terminating short of said center line extending inwardly deforming the deformable ring. The deformable ring D is preferably of substantially circular cross section carried within an arcuate trough defining a part of said first groove A having a radius providing a curvature substantially greater than that of said deformable ring and positioned inwardly thereof toward said first groove and away from and end of said cylinder. The first groove A is spaced axially inwardly of the second groove outwardly of a center line of the deformable ring. The first groove is spaced outwardly of the center line by a distance of on the order of about 0.01 inch.

Referring more particularly to FIGS. 9-13, a cylinder is illustrated at 10 having inner walls 11. A piston rod 12 has connection with the piston 13 which is provided with an O-ring 15. Fluid ports 22 are provided adjacent each end of the cylinder and communicate through grooves 30 and passageways 30*a* in the end caps with the interior of the cylinder on either side of the piston 13.

Figure 12:
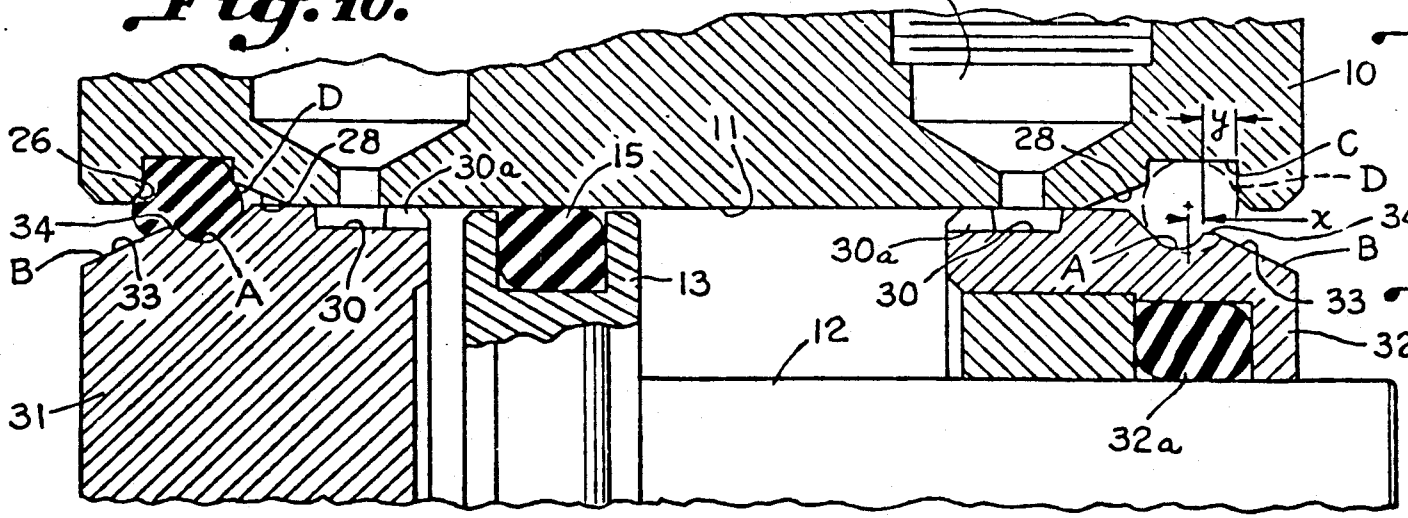
FIG. 12 is a transverse sectional elevation illustrating the assembly with the end caps seated.
Figure 13:
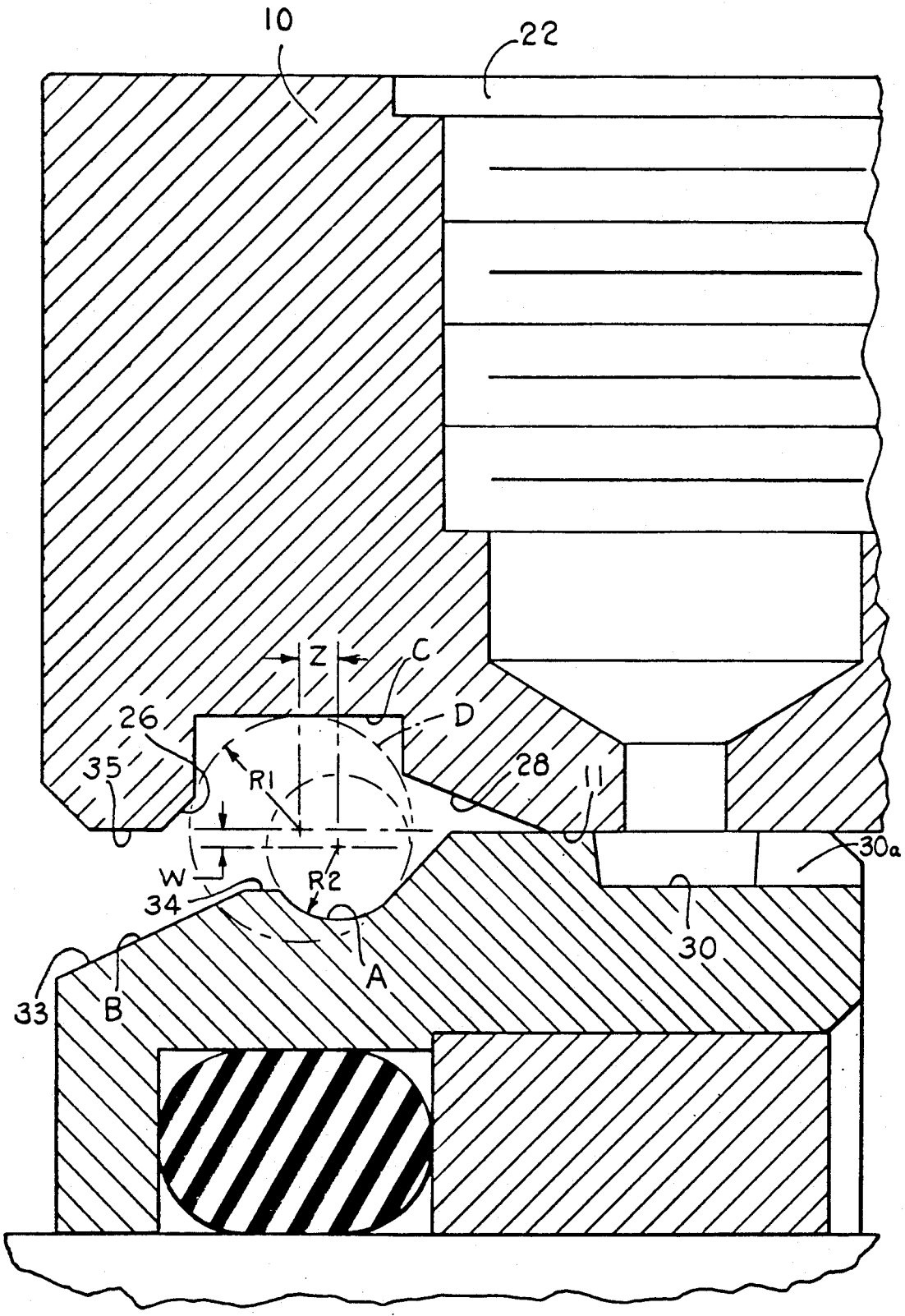
FIG. 13 is an enlarged transverse sectional elevation illustrating the mounting of an end cap within the cylinder.

The end caps 31 and 32 provide a seal at each end of the cylinder. The end cap 32 is provided with an O-ring 32*a* to form a sealing relationship with the piston rod 12 which slides therein. The end caps 31 and 32 are each provided with a first circumferential groove A which is generated for the most part by a radius of a circle R2 which is smaller than the radius R1 of the O-ring D as is best seen in FIGS. 12 and 13 and which is spaced axially inwardly of a second circumferential groove C. The center of the radius R2 is spaced radially below the center of the radius R1 by the amount W and inwardly thereof by the amount Z as illustrated in FIG. 13. The ramp 33 which forms a part of the reduced end portion B is preferably of substantially conical configuration and joins with the groove A by a cylindrical portion 34, defining a retaining ridge, the apex of which is flat cylindrical portion 34. The second circumferential groove C includes the tapering surface 28 which is at an angle of about 20 degrees with the inner wall 11 of the cylinder.

Assembly of the cylinder and end caps is facilitated by the ramp member 33 which passes within the O-ring D as illustrated in FIGS. 10-13. The retaining ridge 34 presses inwardly against the O-ring D at a point short of the center line thereof by the amount X illustrated in FIG. 12. Thus, pressure is exerted against the O-ring at its point of maximum effectiveness which is short of the center line. The inner edge of the retaining ridge which is a juncture between the groove A and the cylindrical surface 34 defining the apex of the retaining ridge is spaced inwardly of the groove C by the amount Y as illustrated in FIG. 12. The construction described provides a blowout pressure for the end caps, for example 5,000 pounds, while a 30 pound pressure is required to disassemble the end caps from the cylinder by pressing inwardly against the end caps. Such pressures are achieved by utilizing a distance X of 0.01 inch and providing a a bevel of 0.01 inch at 45 degrees at the bevel 26. The groove C is 0.065 inches across at the base and has a depth of 0.035 inches with respect to the inner diameter of the cylinder 35. The disassembly operation is substantially the opposite of the assembly described above and in FIGS. 9-12 of the drawings. First, one of the end caps would be removed by pressing same inwardly past the O-ring and then removing the O-ring preparatory to removing the first of the end caps. The other cap may be similarly removed. While the O-ring, as described, or ring of other arcuate cross-section is preferred, a square ring may be utilized. The groove of the end cap has a curvature greater than that of the ring or other depression for deforming the deformable ring to a substantial degree as illustrated.

While a preferred embodiment of the invention has been described using specific terms, such description is for illustrative purposes only, and it is to be understood that changes and variations may be made without departing from the spirit or scope of the following claims.

What is claimed is:

1. A fluid operated apparatus having a cylinder assembly, a piston and a rod carried thereby comprising:

a cap member carried within said cylinder assembly on at least one side of said piston and being confined entirely within a wall of said cylinder assembly including:

a first circumferential groove in said cap member, a reduced end portion extending from said groove to an outer end of said cap member;

a source of fluid under pressure within said cylinder assembly exerting a force urging said cap outwardly;

a second circumferential groove within said cylinder assembly adjacent an end thereof opposite said first circumferential groove of said cap member;

a deformable ring carried within a space defined between said first and second circumferential grooves in a compressed deformed state for positioning said cap member within said cylinder assembly and providing a fluid seal between the cylinder assembly and the cap member, said compressed, deformed state being characterized by axial extremes of said seal being extruded in the axial direction by said grooves; and a ramp defined by a substantially conical surface extending from said outer end of said end cap terminating opposite said second circumferential groove and tapering inwardly progressively enlarging a circumference of the end cap defined by said ramp terminating short of a center line of said deformable ring;

whereby a compact cap member and a correspondingly compact apparatus is provided as the single deformable ring serves both to position the end cap and to provide a fluid seal.

2. The structure set forth in claim 1 wherein said ramp extends continuously expanding at an angle on the order of about 20 degrees.

3. A fluid operated apparatus having a cylinder assembly, a piston and a rod carried thereby comprising:

a cap member carried within said cylinder assembly on at least one side of said piston and being confined entirely within a wall of said cylinder assembly including;

a first circumferential groove in said cap member, a reduced end portion extending from said groove to an outer end of said cap member;

a source of fluid under pressure within said cylinder assembly exerting a force urging said cap outwardly;

a second circumferential groove within said cylinder assembly adjacent an end thereof opposite said first circumferential groove of said cap member;

a deformable ring carried within a space defined between said first and second circumferential grooves in a compressed deformed state for positioning said cap member within said cylinder assembly and providing a fluid seal between the cylinder assembly and the cap member; and a ramp defined by a substantially conical surface extending from said outer end of said end cap terminating opposite said second circumferential groove and tapering inwardly progressively enlarging a circumference of the end cap defined by said ramp terminating short of a center line of said deformable ring;

a retaining ridge or edge formed by said ramp and said first groove, said ridge or edge having a flat apex terminating short of said center line extending inwardly deforming said deformable ring;

whereby a compact cap member and a correspondingly compact apparatus is provided as the single deformable ring serves both to position the end cap and to provide a fluid seal.

4. A fluid operated apparatus having a cylinder assembly, a piston and a rod carried thereby comprising:

a cap member carried within said cylinder assembly on at least one side of said piston and being confined entirely within a wall of said cylinder assembly including;

a first circumferential groove, and a reduced end portion extending from said groove to an outer end of said cap member;

a source of fluid under pressure within said cylinder assembly exerting a force urging said cap outwardly;

a second circumferential groove within said cylinder assembly adjacent at least one end thereof opposite said first circumferential groove of said cap member; and a deformable ring of arcuate cross section carried within a space defined between said first and second circumferential grooves in a compressed deformed state for positioning said cap member within said cylinder assembly and providing a fluid seal between the cylinder assembly and the cap member;

an arcuate trough defining said first groove having a radius providing a curvature substantially greater than the curvature of said deformable ring and positioned inwardly thereof away from an end of said cylinder; and said first groove being spaced axially inwardly of said second groove away from and end of said cylinder and radially outwardly of a center line of said deformable ring;

whereby a compact cap member and a correspondingly compact apparatus is provided as the single deformable ring serves both to position the end cap and to provide a fluid seal.

5. The structure set forth in claim 4 wherein said first groove is spaced outwardly of said center line by a distance of on the order of about 0.01 inch.

* * * * *